United States Patent [19]

Parkins et al.

[11] 4,438,694

[45] Mar. 27, 1984

[54] GRAVURE COLOR PRINTING PRESS

[75] Inventors: David W. Parkins, Bedford; David K. Thomas, Leighton Buzzard; Peter C. Pugsley, Pinner; Benjamin J. Price, Haywards Heath, all of England

[73] Assignee: Crosfield Electronics Limited, London, England

[21] Appl. No.: 298,407

[22] Filed: Sep. 1, 1981

[30] Foreign Application Priority Data

Sep. 3, 1980 [GB] United Kingdom ..... 8028364

[51] Int. Cl.[3] ..... B41F 5/18

[52] U.S. Cl. ..... 101/152; 101/185; 101/247; 101/178

[58] Field of Search ..... 101/136, 140, 152, 174, 101/185, 169, 416 A, 247, 178; 92/130 B

[56] References Cited

U.S. PATENT DOCUMENTS

| | | | |
|---|---|---|---|
| 1,808,476 | 6/1931 | Pinder | 101/416 |
| 1,966,287 | 7/1934 | Fischer | 101/152 |
| 2,676,537 | 4/1954 | Kanitz | 101/153 |
| 2,981,237 | 4/1961 | Gratzmuller | 92/130 B |
| 3,131,631 | 5/1964 | Haskin | 101/152 |
| 3,316,838 | 5/1967 | DesLyons DeFeuchin | 101/152 |
| 3,394,631 | 7/1968 | Thompson | 92/130 B X |
| 3,536,006 | 10/1970 | Roozee | 101/148 |
| 3,894,488 | 7/1975 | Gazzola et al. | 101/152 X |
| 4,019,617 | 4/1977 | Englund et al. | 101/91 X |
| 4,085,672 | 4/1978 | Grosart | 101/169 |

FOREIGN PATENT DOCUMENTS

| | | | |
|---|---|---|---|
| 905637 | 9/1962 | United Kingdom | 101/136 |
| 1366447 | 9/1974 | United Kingdom | 101/174 |

*Primary Examiner*—Clifford D. Crowder
*Assistant Examiner*—John A. Weresh
*Attorney, Agent, or Firm*—Sughrue, Mion, Zinn, Macpeak and Seas

[57] ABSTRACT

A color gravure printing press of simple construction which is easy to set up and operate, and is therefore economic for use in printing short runs comprises printing members (2) for at least two different colors arranged around a common printing cylinder (1), an impression cylinder (3) including means (11) to hold a sheet of substrate (15) to be printed, and at least as many inking assemblies (4) as there are different color printing members (2) arranged around the printing cylinder (1). Each of the inking assemblies (4) includes a doctor blade (35) movable towards and away from the printing cylinder (1). The press is arranged so that each inking assembly (4) applies ink only to its corresponding printing member (2) and each doctor blade (35) contacts only its corresponding printing member (2), and that the substrate (15) is held in a fixed position on the impression cylinder (3) until it has been contacted and printed by all of the different color printing members (2). Consequently it is economically possible to use this simple press as a color proof press for proofing a stream of digital data before preparing a full color set of conventional gravure printing members from it.

2 Claims, 12 Drawing Figures

GRAVURE COLOR PRINTING PRESS

BACKGROUND OF THE INVENTION

This invention relates to a printing press using a gravure printing process in which a printing member or plate is engraved with an ink receiving matrix, the depth of the engraved matrix determining the quantity of ink which is placed on the substrate and hence the depth of colour applied to the substrate. In a typical gravure printing press, the printing member has the form of a cylindrical roll with the image engraved in its outer surface. The engraved roll is rotated about its longitudinal axis and dips into an ink-containing bath which coats the roll with ink. Ink is scraped from the surface of the engraved roll by a doctor blade which removes all of the ink from the surface and just leaves the ink which remains in the engraved ink receiving matrix. Further rotation of the ink filled roll brings it into contact with the substrate to be printed, typically paper, and the ink is transferred from the matrix onto the surface of the substrate. In colour printing by the gravure process there are two or more such presses arranged in series one downstream of the other and an ink drying station is provided downstream from each press to ensure that the ink on the substrate from that press is dry before the substrate reaches the next press. Such presses are fed by a continuous web of paper and the various printing presses are kept in synchronism with one another so that the impressions from successive printing machines are registered one on top of the other.

Typically, for full colour printing, there are four separate printing presses downstream from one another. Each of the presses provides a printing impression of different colour and in a four colour process the different presses use black, yellow, cyan and magenta coloured inks. Such printing presses are very large and a considerable effort is involved in the preparation of their printing members and in their initial setting up to ensure that the impressions printed by each press are in exact registration with one another and to ensure that they continue to run in synchronism with one another.

Nowadays, the image which is to be printed is usually scanned by an electronic scanner and is encoded into the form of a string of digital data. It is possible to operate on this data to enlarge or reduce the size of the image, to apply colour corrections, and to vary the layout of pages to be printed. A set of printing members for four colour printing is then prepared directly from this data after it has been operated upon. Thus, the set of printing members is prepared without any initial visual inspection or proofing step. In view of the difficulty and expense of preparing such a set of printing members and the difficulty of setting up a conventional gravure colour press, it is desirable to be able to proof the digital data to ensure that it is satisfactory before undertaking the preparation of the set of printing members and undertaking the complete setting up of a conventional colour gravure printing press.

SUMMARY OF THE INVENTION

This invention provides a colour gravure printing press of simple construction which is easy to set up and operate and is therefore economic for use in printing short print runs. Consequently, it is economically possible to use this simple press as a colour proof press for proofing digital data before preparing a full colour set of conventional gravure printing members from it.

According to this invention, a gravure colour printing press includes printing members for at least two different colours arranged around a common printing cylinder, an impression cylinder including means to hold a sheet of substrate to be printed, and at least as many inking assemblies as there are different colour printing members arranged around the printing cylinder, each of the inking assemblies including a doctor blade movable towards and away from the printing cylinder, the arrangement of the press being such that each inking assembly applies ink only to its corresponding printing member and each doctor blade contacts only its corresponding printing member, and that the substrate is held in a fixed position on the impression cylinder until it has been contacted and printed by all of the different colour printing members.

Since the colour gravure printing press in accordance with this invention includes only a single printing station at which all of the colours are printed upon the substrate and because a single sheet of substrate is fixed in position on the impression cylinder throughout the printing of all of the colours, the press is very much smaller and easier to set up to ensure that accurate registration takes place between each successive colour impression than a conventional colour gravure press.

Since there is no movement of the substrate relative to the impression cylinder and since all the printing members are associated with the same printing cylinder, once the location of the printing members around the printing cylinder has been established, subsequent registration between the printing of the differently coloured impressions depends solely upon the relative movement of just the single printing cylinder and the single impression cylinder.

The ink applied to the substrate from one printing member must be dry before the ink from the next printing member is applied on top of it to prevent the differently coloured inks mixing and to prevent contamination between the differently coloured inks. It may be possible to use inks which dry or cure during a single revolution of the impression cylinder. However, to ensure that any proofs prepared by the press in accordance with this invention resemble the results that will be obtained with a conventional gravure press it is preferred that the press is used with conventional gravure inks, which rely on solvent evaporation to dry them. In this case it is preferred that the impression cylinder and the printing cylinder are movable apart from one another to allow the impression cylinder to continue to rotate in step with the printing cylinder without printing taking place. This gives the ink on the substrate held on the impression cylinder an opportunity to dry before the impression cylinder and the printing cylinder are once again brought together so that the next colour printing member prints the next colour onto the substrate.

With the printing press arranged in this way, it is preferred that the axis of the impression cylinder is moved towards and away from that of the printing cylinder and the axis of the printing cylinder remains fixed in position. Preferably the impression cylinder is moved to and fro by fluid pressure operated piston and cylinder assemblies with the final printing pressure between the impression cylinder and the printing cylinder being established by springs.

The press may include an ink drying and cooling arrangement comprising a pair of ducts extending along the length of the impression cylinder and means to supply hot air to the upstream one of these and cold air through the downstream one. The hot air assists in the evaporation and removal of the solvent from the ink while the cold air cools the surface of the printing substrate so that it is ready to receive ink from the next printing member.

When the impression and printing cylinders are arranged to move away from one another, it is important that the ink on the printing members on the printing cylinder is refreshed from time to time so that all the solvent does not evaporate from the ink remaining in the ink receiving matrix of the printing members and so clog up the ink receiving matrix of the printing members. Preferably the inking assemblies contact their corresponding printing members once during each revolution of the printing cylinder irrespective of whether or not the impression cylinder is in contact with the printing cylinder.

Preferably each inking assembly moves towards and away from the printing cylinder. The press may include means to control the supply of ink to each particular inking assembly so that ink is only fed to an inking assembly when the doctor blade of that inking assembly is in contact with its corresponding printing member. In this case the means to control the supply of ink also withdraws the supply of ink from the inking assembly at the end of the inking operation of its corresponding printing member. However, it is preferred that each inking assembly includes an ink channel on the upstream side of its doctor blade and includes a pivoted blade which seats against its doctor blade to close the ink channel and shut off the supply of ink to the printing member.

The peripheral speed of both the impression cylinder and the printing cylinder must be substantially the same and, when the printing cylinder carries four printing members, it is preferred that the periphery of the printing cylinder is at least four times as great as that of the impression cylinder. In this case, the impression cylinder must rotate with an angular speed at least four times that of the printing cylinder. The impression cylinder and the printing cylinder may be connected together through a mechanical gear train and, for example, the inking assemblies may be linked to a printing cylinder through a mechanical coupling including, for example, a cam and cam follower arranged so that the inking assemblies move towards and away from the printing cylinder during each rotation of the printing cylinder. With the press arranged in this way, the operation of the entire press is synchronised and driven by a single mechanical drive.

However, it is preferred that all the various parts of the press include an independent drive and then their operation is synchronised by an electronic control system. In this case, the printing cylinder and the impression cylinder both include angular position encoders which encode their angular position into the form of electronic signals. A drive for moving each of the inking assemblies towards and away from the printing cylinder is then controlled in dependence upon the angular position of the printing cylinder, and the relative speeds of the printing cylinder and the impression cylinder are then controlled by comparing the signals representing their angular positions after that of the impression cylinder has been multiplied by a scaling factor representing the ratio of the diameters of the two cylinders.

The printing press may be manually sheet fed but preferably it includes an automatic sheet feeder to feed sheets to the impression cylinder one at a time from a stack of sheets. Alternatively, it may include a sheet feeder which provides individual sheets from a roll or web of material and then feeds these one at a time to the impression cylinder.

BRIEF DESCRIPTION OF THE DRAWINGS

One particular example of a printing press in accordance with this invention will now be described with reference to the accompanying drawings; in which.

DESCRIPTION OF THE PREFERRED EMBODIMENTS

Figure 1:
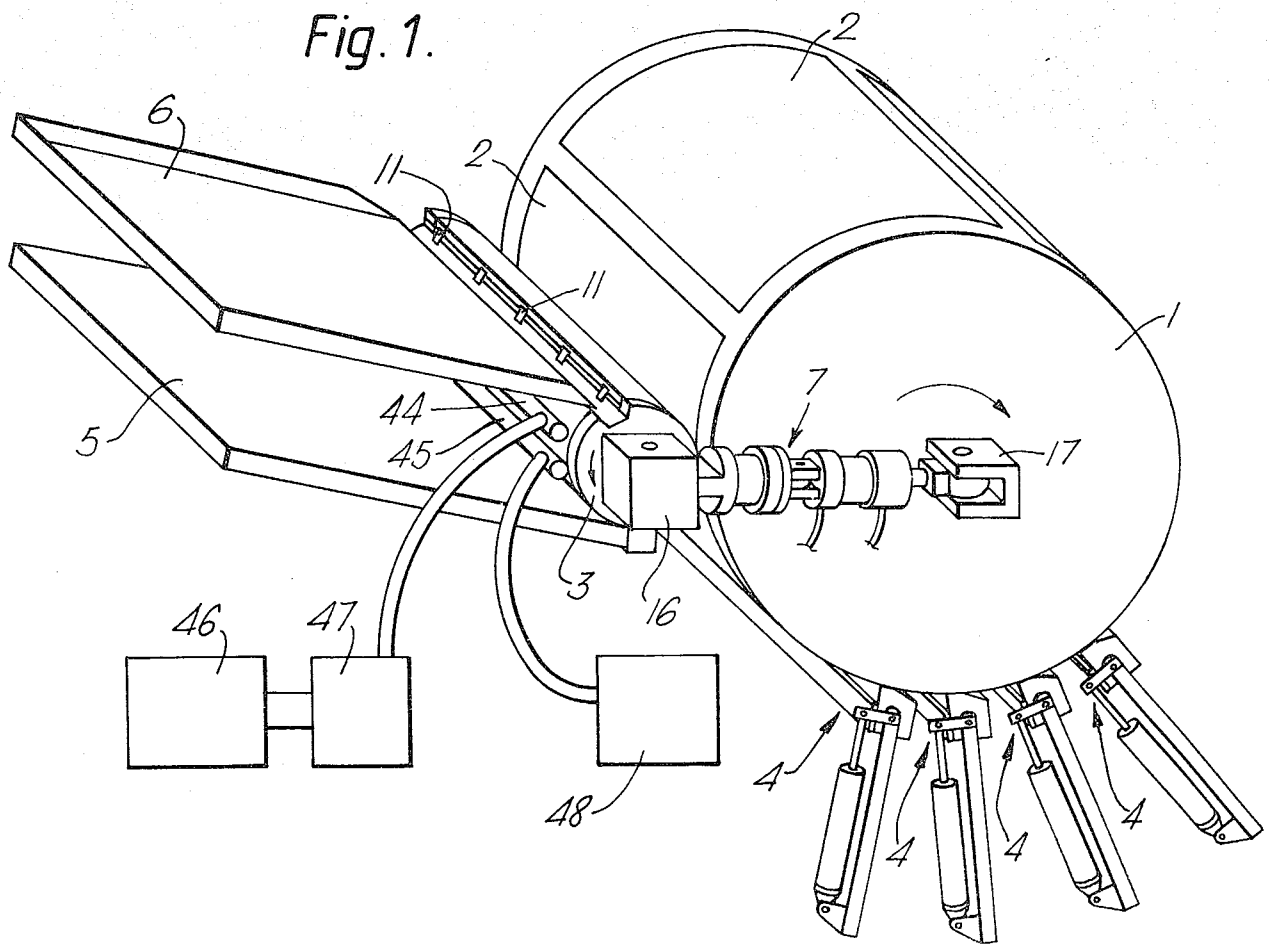
FIG. 1 is a somewhat diagrammatic perspective view of the press.

The press comprises a printing cylinder 1 having four printing members 2 arranged around its periphery. The four printing members 2 each correspond to a different colour separation of the same coloured image and preferably the printing members 2 are each formed by a separate ink receiving matrix engraved into the surface of a plastics material extending around the entire periphery of the printing cylinder 1. However, the printing members 2 may each be formed on separate sheets of plastics material. The press also comprises an impression cylinder 3, four separate inking assemblies 4 which are all generally similar in construction but which, in use, are loaded with inks of different colour, a paper feeding tray 5, and a completed print receiving tray 6. The printing cylinder 1 is connected to the impression cylinder 3 by a pair of nip pressure control assemblies 7 arranged and acting between the axes of the printing cylinder 1 and the impression cylinder 3.

The impression cylinder 3 is formed by a cylindrical metal cylinder covered by a gravure blanket 8 one end of which is held by a block 9 and the other end of which is held by a tensioning arrangement 10. A gripper arrangement operating with the block 9 comprises a number of spring-loaded axially spaced grippers 11 which bear against a rubber-covered bar 12, the rubber-covered bar 12 being connected to a pair of spring loaded arms 13 which bias the bar 12 outwards away from the impression cylinder 3. The grippers 11 are all journalled onto an axle 14 and have some limited angular movement around the axle 14 but, upon rotation of the axle 14 the grippers 11 are moved outwards away from the cylinder 3. The axle 14 is connected to a pinion (not shown) at the outside end of the impression cylinder 3 and when this pinion engages a toothed cam (also not shown) this causes the axle 14 to rotate to move the grippers out of engagement with the rubber covered bar 12.

Figure 2:
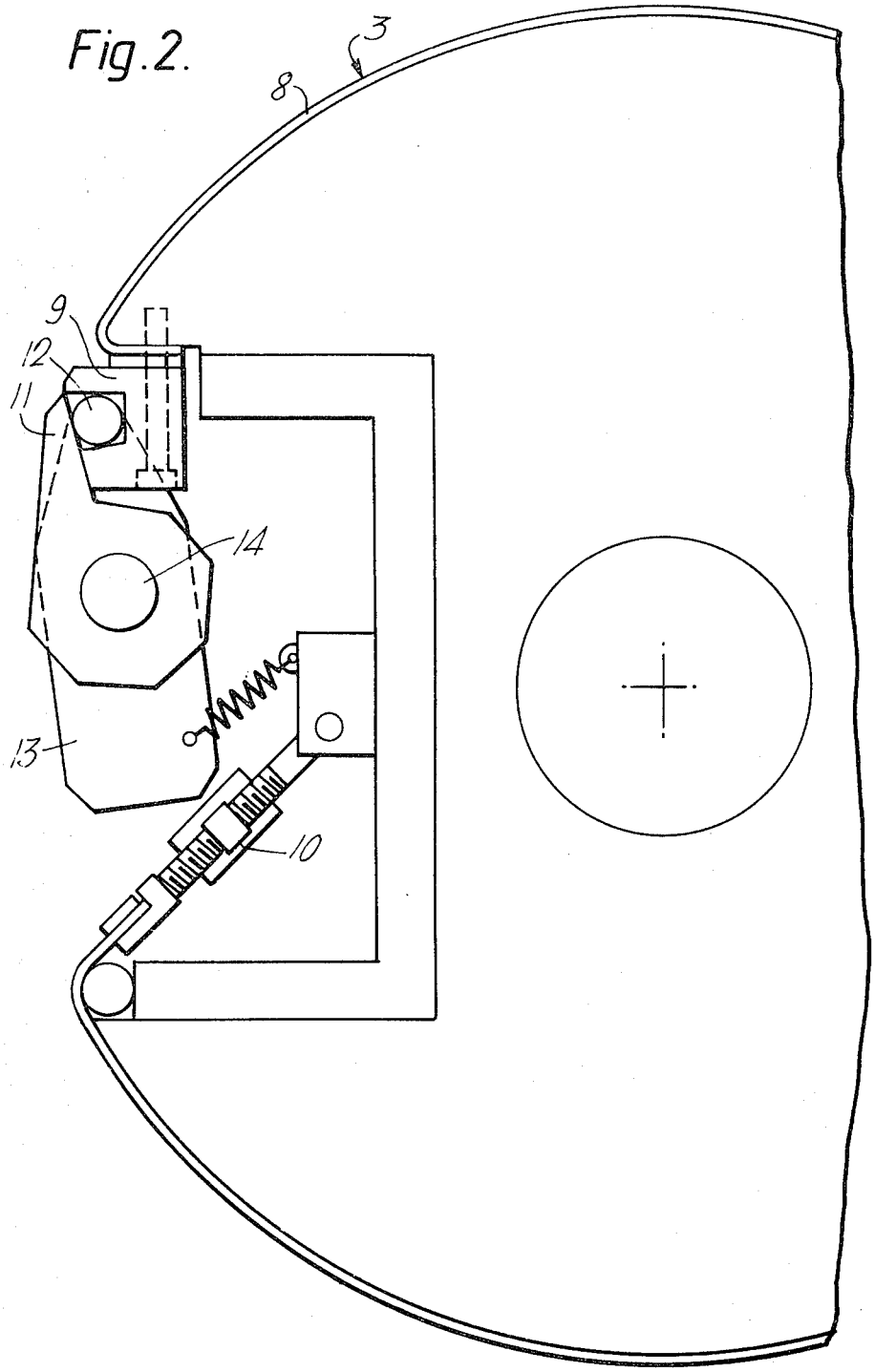
FIG. 2 is a cross section through the impression cylinder showing the paper clamping arrangements.
Figure 3B:
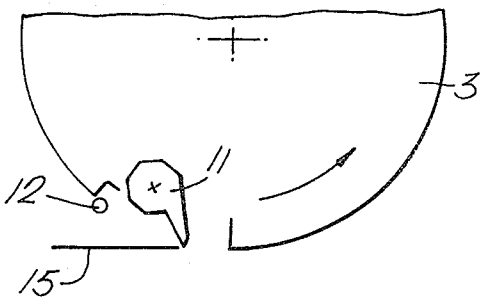
FIGS. 3A to 3E are a series of diagrams showing how a sheet of paper is gripped by the paper grippers on the impression cylinder.
Figure 3A:
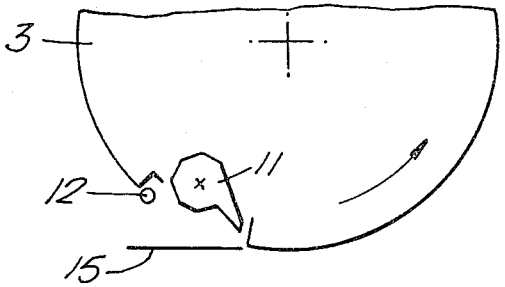
Figure 3E:
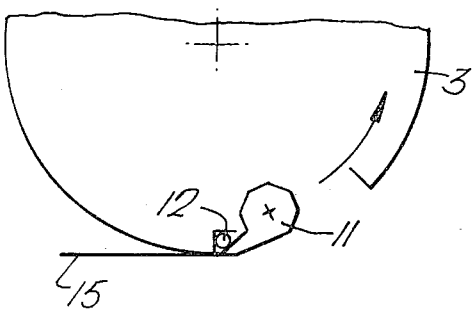
Figure 3D:
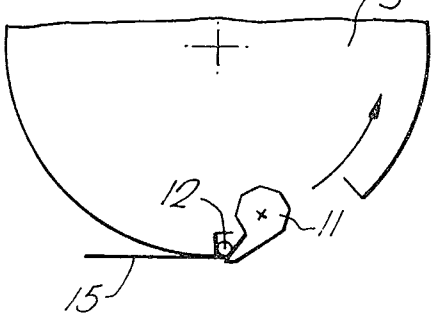
Figure 3C:
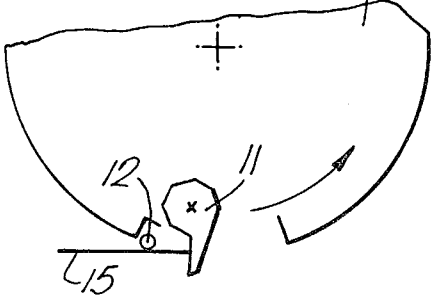

To load a sheet of paper from the paper tray 5 onto the impression cylinder 3 the toothed cam is actuated to engage the pinion and rotate the grippers 11 in the anti-clockwise direction as shown in FIGS. 2 and 3. When the grippers 11 are moved into their open position shown in FIG. 3A they also release the rubber-covered bar 12 and this moves outwards under its spring bias, again as shown in FIG. 3A. A sheet of paper 15 is located on the paper tray 5 and is located adjacent the periphery of the cylinder 3, again as shown in FIG. 3A. As the impression cylinder 3 is rotated past the sheet of paper 15 the rubber-covered bar 12 engages the sheet 15 and pulls it forwards beneath the impression cylinder 3. The grippers then close moving in a clockwise direction as shown in FIGS. 2 and 3. The closing movement of the grippers 11 is also controlled by the toothed cam and pinion connected to the axle 14. Thus, as shown in the sequence of FIGS. 3A to 3E the grippers 11 grip the edge of the sheet of paper 15 between the grippers 11 and the rubber covered bar 12 and then forward movement of the sheet of paper 15 from the paper tray 5 continues with the sheet being wrapped around the outside of the blanket 8 on the impression cylinder 3.

The sheet of paper 15 is held on the impression cylinder 3 throughout the printing operation and then, once the printing operation has been completed, the toothed cam is once again brought into contact with the pinion at the end of the axle 14, and this opens the grippers 11. The opening of the grippers 11 releases the rubber covered bar 12 which pushes the previously gripped edge of the sheet of paper outwards away from the impression cylinder 3 so that the sheet of paper passes over the edge of the print receiving tray 6. Further rotation of the cylinder 3 and the inertia of the paper means that the completed print is deposited in the print receiving tray 6 and then, during the further rotation of the impression cylinder 3 the next sheet of paper is taken from the paper feeding table 5.

Figure 4:
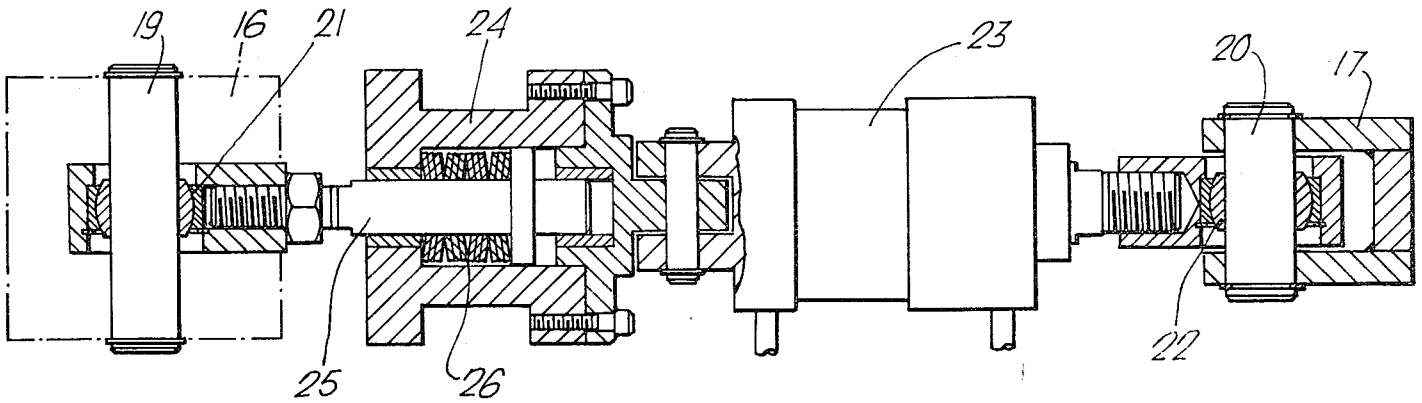
FIG. 4 is a partly sectioned side elevation of the nip pressure control assemblies.
Figure 5:
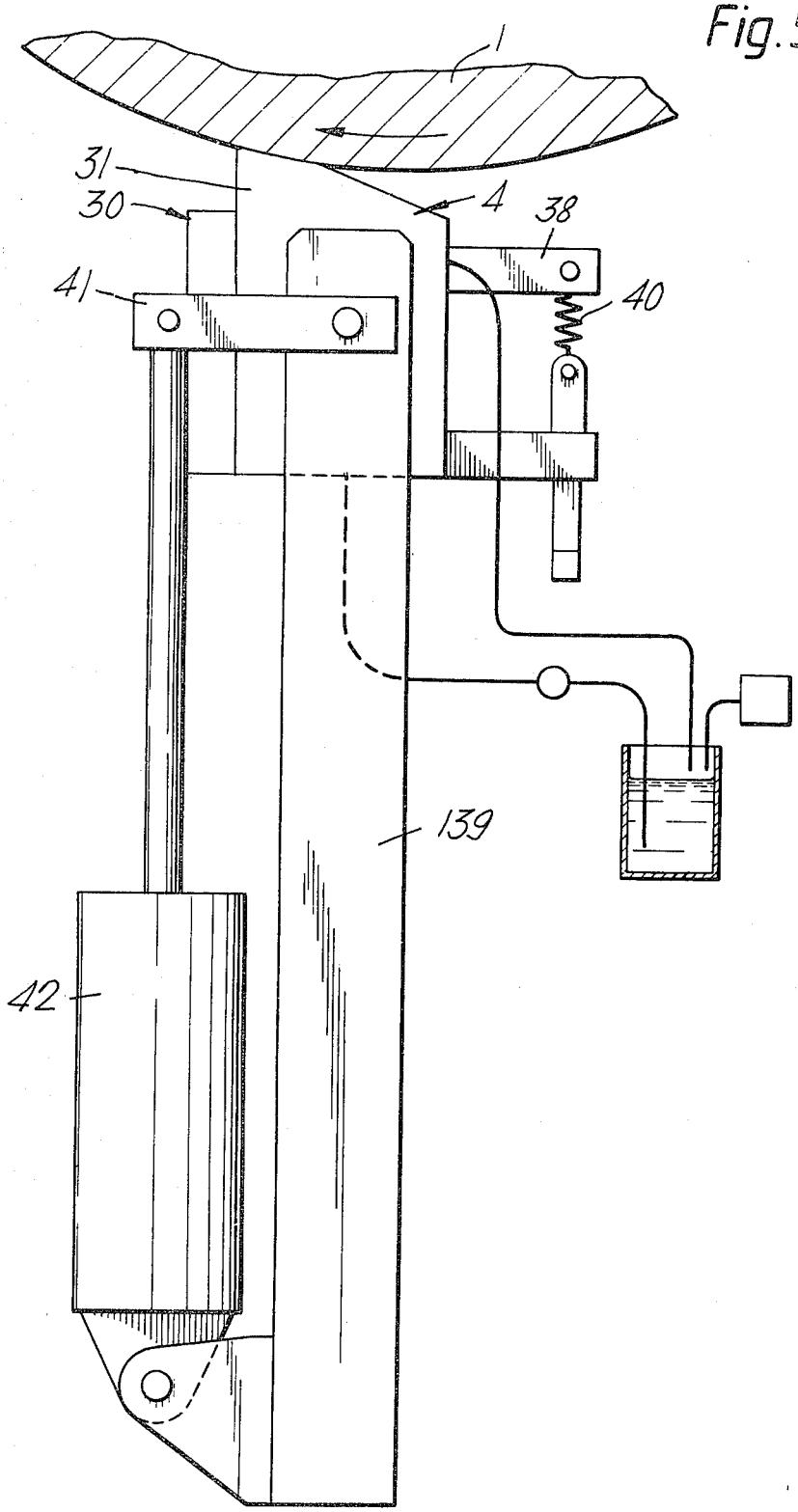
FIG. 5 is a side elevation of the arrangement of one of the inking assemblies.

The impression cylinder 3 is mounted for movement towards and away from the printing cylinder 1, and the movement of the impression cylinder 3 towards and away from the printing cylinder 1 together with the nip pressure determining the nip pressure between the printing cylinder 1 and the impression cylinder 3 is governed by the pair of assemblies 7 which are shown in more detail in FIG. 4. The stub axles (not shown) of the impression cylinder 3 are connected to blocks 16. Blocks 17 arranged on opposite sides of the printing cylinder 1 are connected to the axles of the printing cylinder 1 or the frame supporting the axles of the printing cylinder 1. The assembly 7 is connected to pins 19 and 20 passing through the blocks 16 and 17 by spherical bearings 21 and 22. The assembly 7 comprises a double acting hydraulic piston and cylinder assembly 23 one end of which is connected to the spherical bearing 22 the other end of which is connected to a spring housing 24. The other spherical bearing 21 is connected to a plunger 25 journalled into the spring housing 24 with a number of annular dished plate springs 26 arranged and acting between the plunger 25 and the spring housing 24. The spring housing 24 also includes a pair of lugs 27 at its end adjacent the block 16.

When hydraulic fluid is passed to the piston and cylinder assembly 23 to cause the piston rod to move out of the cylinder the lugs 27 bear against the block 16 and the hydraulic piston and cylinder assembly 23 urges the impression cylinder 3 away from the printing cylinder 1. Upon opposite connection of the hydraulic piston and cylinder assembly 23 the spring housing 24 is moved towards the block 17 by the action of the hydraulic piston and cylinder assembly 23. This movement of the spring housing 24 compresses the springs 26 and they, in turn, transmit movement via the plunger 25 to the block 16. The piston bottoms in the cylinder of the hydraulic piston and cylinder assembly 23 and thus the dished springs 26 govern the nip pressure that is exerted between the impression cylinder 3 and the printing cylinder 1.

The four inking assemblies 4 are each generally similar and a particularly suitable inking assembly is described and claimed in our co-pending U.S. application Ser. No. 298,393 filed on the same day as the present application and claiming priority from British application No. 8028366. Each inking assembly comprises a doctor blade assembly 30, an ink channel 31, a pivoted blade 32 and a containing blade 33. The doctor blade assembly 30 is conventional and comprises a pair of spring steel blades 34 and 35 inclined towards and bearing against one another, the spring steel blade 35 being a doctor blade. The spring steel blades 34 and 35 are clamped onto and define the downstream side wall of the ink channel 31. The pivoted blade 32 has a seating surface along its free edge which, in one position of the pivoted blade 32 bears against and seals against the doctor blade 35. The containing blade 33 is made from nylon or other plastics material and is arranged to be a distance of substantially one millimeter away from the surface of the printing cylinder 1 when the doctor blade 35 is engaged with the printing cylinder 1. The containing blade 33 forms the upstream edge of the ink channel 31. A strip of rubber or other elastomeric material 36 is sandwiched between the upstream side of the pivoted blade 32 and the side of the ink channel 31 to form a seal to prevent ink from the base of the ink channel 31 passing upwards and over the upstream side of the pivoted blade 32. Ink is pumped into the channel 31 through an inlet 37.

Figure 6:
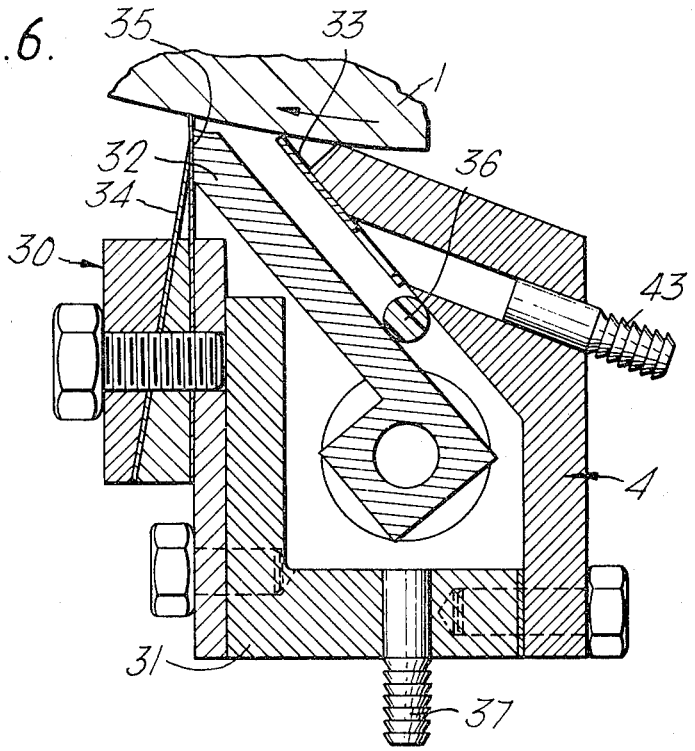
FIG. 6 is a cross section through the ink channel of one of the inking assemblies in the first position.
Figure 7:
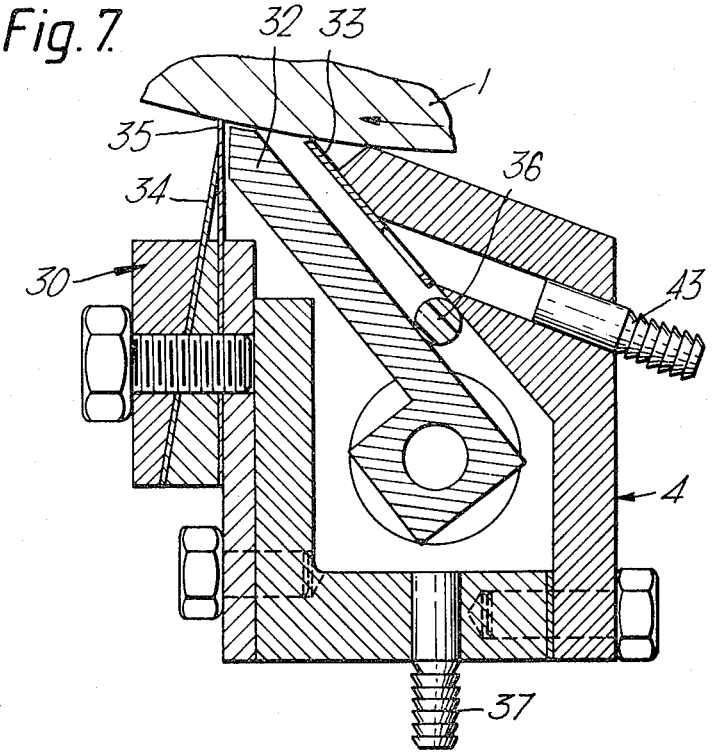
FIG. 7 is a cross-section through the ink channel of one of the inking assemblies in the second position; and, FIG. 8 is a block diagram of the control circuit of the press.

The ink channel 31 rotates about the pivot axis of the blade 32 which is parallel to the axis of the printing member 1. An arm 38 is connected to the ink channel 3 and connected to a frame 39 attached rigidly to and forming part of the main framework of the press by a spring 40. The pivoted blade 32 is connected to a crank arm 41 which is in turn connected to one end of a pneumatic piston and cylinder assembly 42, the other end of which is also connected to the frame 39. Operation of the pneumatic piston and cylinder assembly 42 causes the pivoted blade 32 to pivot. Preferably a vacuum is applied to the upstream side of the pivoted blade 32 via a connection 43. Upon actuation of the pneumatic piston and cylinder assembly 42, the blade 32 pivots in the anti-clockwise direction as seen in FIGS. 6 and 7 so that it seats against the doctor blade 35 to cut off the supply of ink from the ink channel to the surface of the printing member 1. Further movement of the pneumatic piston and cylinder assembly 42 causes the entire ink channel 31 to pivot to move the doctor blade 35 and that part of the ink channel 31 adjacent the printing cylinder 1 away from the printing cylinder 1. The press is arranged so that during each revolution of the printing cylinder 1 each of the inking assemblies 4 applies ink only to its corresponding printing member 2.

An ink drying arrangement comprises ducts 44 and 45 extending axially along adjacent the impression cylinder 3. Air from a blower 46 and a heating chamber 47 is directed through the duct 44 onto the surface of the substrate to help remove the solvent from the ink on the surface of the substrate. Cold air from a blower 48 is directed at the surface of the substrate also to assist in the removal of the solvent from the ink but principally to cool the surface of the substrate so that it is cool enough to accept ink of the next colour.

The printing cylinder 1 is driven by a synchronous motor (not shown) and so rotates at a substantially constant speed. The impression cylinder 3 is driven by a variable speed DC torque motor 49. Both the printing cylinder 1 and the impression cylinder 3 include angular position encoders 50 and 51 (FIG. 8), and an electronic control system is provided to maintain in synchronism the cylinders 1 and 3 to ensure that their peripheral speed is the same and to control the operation of the pneumatic cylinders 42 of each of the inking assemblies 4 and the hydraulic piston and cylinder assemblies 23. The electronic control system also governs the operation of the grippers 11 and the supply of air by the blowers 46 and 48 and the heater 47.

Figure 8:
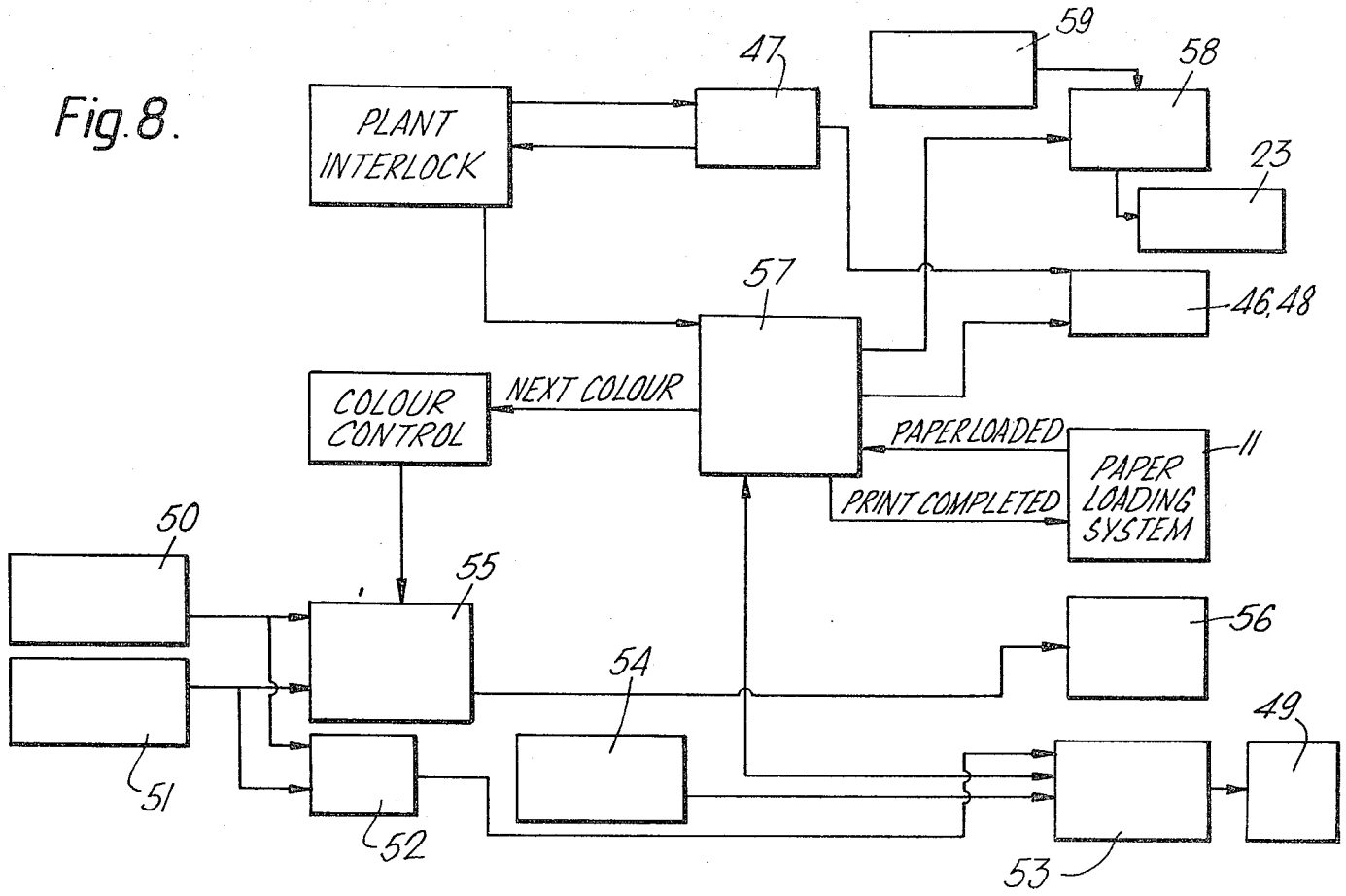

Referring to FIG. 8, the output from the position encoders 50 and 51 are compared by a comparator 52 to provide an output signal in the event of any difference in phase between the position encoders of the printing cylinder 1 and impression cylinder 3. The output from the comparator 52 is fed to a DC power amplifier 53 which feeds the DC torque motor 49. A velocity control circuit 54 also feeds a signal to the power amplifier 53. The outputs from the angular position encoders 50 and 51 are also fed to a circuit 55 which compares the relative angular position of the printing cylinder 1 and impression cylinder 3 and outputs an error signal to an ink control circuit 56 which actuates and controls the operation of the inking assemblies 4. A main control circuit 57 controls the operating sequence of the printing press and controls the time between successive colour prints. The control circuit 57 also controls the operation of the heaters and blowers 46, 47 and 48 and a valve 58 controlling the application of hydraulic fluid from a hydraulic supply 59 to the hydraulic piston and cylinder assemblies 23. The control circuit 57 also governs the operation of the grippers 11 and the remainder of the paper loading and discharging system.

In operation of the printing press, the printing members 2 are prepared around the periphery of the printing cylinder 1 and then the printing cylinder 1 rotates. During each rotation, the inking assemblies 4 move towards the printing cylinder 1 and each engage with their corresponding printing member 2 to ink the printing members 2 with ink of the appropriate colour. The sheet of paper 15 is gripped by the grippers 11 and the rubber covered bar 12 and wrapped around the impression cylinder 3. The impression cylinder rotates at an angular speed which is approximately four times greater than that of the printing cylinder 1 under the control of the electronic control circuits. The impression cylinder 3 is then urged against the printing cylinder 1 by actuation of the hydraulic piston and cylinder assemblies 23 to bring the paper 15 into contact with the first of the printing members 2 so that the paper 1 is printed with the first colour ink. The impression cylinder 3 is then urged away from the printing cylinder 1 but continues to rotate in synchronism with the printing cylinder 1. Hot air is discharged from the hot air supply duct 44 and cold air discharged from the cold air supply duct 45 to dry the ink on the paper held on the impression cylinder 3 as this rotates. As soon as the ink is dry the control circuit 57 again actuates the hydraulic piston and cylinder assemblies 23 to bring the impression cylinder 3 into contact with the printing cylinder 1 only this time the impression cylinder 3 is urged against the next printing member 2 on the printing cylinder 1. This prints the next colour impression in exact registration with that of the first colour already on the paper 15 and once again the impression cylinder 3 and printing cylinder 1 are urged apart from one another. The two cylinders again continue to rotate while the second ink impression is dried. This process is repeated for each of the four printing members and then, after the fourth ink impression has been dried, the grippers 11 are actuated to release the paper from the impression cylinder 3 and to discharge it into the tray 6. The process is then repeated to produce further copies.

While a manually fed version of the proofing press has been described in this specification, in practice, the press will also include a sheet feeder to feed sheets of paper one at a time onto the paper feeding tray 5. Typical sheet feeding machines suitable for use with this this press are manufactured by Heywood Auto Feed of London, Great Britain, and H. T. B. Limited of Basildon, Essex, their "HTB Harrier" machine.

We claim:

1. A gravure color printing press, comprising:

a printing cylinder;

four printing members (2) each for a different color arranged around said printing cylinder;

an impression cylinder (3);

means for holding a sheet of substrate (15) to be printed on said impression cylinder;

four inking assemblies (4), each of said inking assemblies including a doctor blade (35) movable towards and away from said printing cylinder, each of said inking assemblies including an ink channel (31) upstream of its doctor blade and including a pivoted blade (32), said pivoted blade seating against said doctor blade to close said ink channel and cut off a supply of ink to said printing member;

means (7) for moving said impression cylinder towards and away from said printing cylinder, said moving means comprising fluid pressure operated piston and cylinder assemblies (23) and spring means (26) connected together in series and acting between said impression cylinder and said printing cylinder, said spring means defining a final printing pressure between said impression cylinder and said printing cylinder;

an ink dryer and cooler, said ink dryer and cooler comprising an upstream duct (44) and a downstream duct (45) which extend along said impression cylinder, means (46, 47) to supply hot air to said upstream duct, and means (48) to supply cold air to said downstream duct; and a control system means (49–59) for controlling the operation of each of the inking assemblies so that each of said inking assemblies only supplies ink to its corresponding printing member and each of said doctor blades contacts only its corresponding printing member, said control system means controlling said means for holding a sheet of substrate so that the substrate is held in a fixed position on said impression cylinder until said substrate has been contacted and printed by all of said different color printing members, said control system means controlling a rotation of said impression cylinder and said printing cylinder so that said impression cylinder continues to rotate in step with said printing cylinder when said means for moving said impression cylinder has moved said impression cylinder away from said printing cylinder whereby ink on said substrate held on said impression cylinder is allowed to dry before said impression cylinder and said printing cylinder are once again brought together to print the next color onto said substrate, said inking assemblies always contacting their corresponding printing member once during each revolution of said printing cylinder.

2. A printing press according to claim 1, wherein said control system means includes:

angular position encoders (50, 51) attached to said printing cylinder and said impression cylinder, said angular position encoders encoding an angular position of said printing cylinder and said impression cylinder into electronic signals;

first means (49, 52, 53, 54) responsive to said electronic signals for moving each of said inking assemblies towards and away from said printing cylinder in dependence upon the angular position of said printing cylinder; and second means (55) responsive to said electronic signals for controlling relative speeds of said printing cylinder and said impression cylinder.

* * * * *